US006032631A

United States Patent [19]

Haas et al.

[11] Patent Number: 6,032,631

[45] Date of Patent: Mar. 7, 2000

[54] TAPPET FOR A VALVE TRAIN OF AN INTERNAL COMBUSTION ENGINE

[75] Inventors: Michael Haas, Weisendorf; Walter Speil, Ingolstadt, both of Germany

[73] Assignee: Ina Walzlager Schaeffler oHG, Germany

[21] Appl. No.: 09/117,548

[22] Filed: Sep. 11, 1998

[30] Foreign Application Priority Data

Feb. 3, 1996 [DE] Germany ..... 196 03 915

[51] Int. Cl.[7] ..... F01L 1/24; F01L 1/14

[52] U.S. Cl. ..... 123/90.55; 123/90.5

[58] Field of Search ..... 123/90.35, 90.48, 123/90.49, 90.5, 90.55

[56] References Cited

U.S. PATENT DOCUMENTS

| | | | |
|---|---|---|---|
| 4,648,360 | 3/1987 | Schaeffler | 123/90.55 |
| 4,747,376 | 5/1988 | Speil et al. | 123/90.55 |
| 4,756,282 | 7/1988 | Kunz et al. | 123/90.55 |
| 5,188,068 | 2/1993 | Geterman et al. | 123/90.35 |
| 5,450,826 | 9/1995 | Speil | 123/90.55 |
| 5,636,604 | 6/1997 | Speil | 123/90.55 |
| 5,651,335 | 7/1997 | Elendt et al. | 123/90.16 |

FOREIGN PATENT DOCUMENTS

| | | |
|---|---|---|
| 0454518 | 10/1991 | European Pat. Off. . |
| 3627505 | 2/1988 | Germany . |
| 4025234 | 8/1991 | Germany . |
| 4118370 | 12/1992 | Germany . |
| 4138995 | 6/1993 | Germany . |
| 4214839 | 11/1993 | Germany . |
| 4334518 | 4/1994 | Germany . |
| 4308011 | 9/1994 | Germany . |
| 4423996 | 1/1995 | Germany . |
| 4324756 | 2/1995 | Germany . |
| 4415270 | 11/1995 | Germany . |

OTHER PUBLICATIONS

Patent Abstracts of Japan, vol. 12, No. 212 (4 pgs) 63–16112, Jan. 1988.

*Primary Examiner*—Weilun Lo
*Attorney, Agent, or Firm*—Bierman, Muserlian and Lucas

[57] ABSTRACT

In a tappet (1) of a valve train of an internal combustion engine, the leakage of hydraulic medium occurring between its reception bore (6) and skirt (2) is to be reduced. To achieve this, the tappet (1) of the invention comprises an anti-rotation device (22) and, at the same time, a supply of hydraulic medium from a supply gallery (21) to an annular oil reservoir (17) is effected directly, i.e. annular grooves and other oil deflecting measures are dispensed with. An aperture (19) in the skirt (2) for the supply of hydraulic medium can, at the same time, be advantageously arranged in a bottom-proximate region thereof.

11 Claims, 4 Drawing Sheets

TAPPET FOR A VALVE TRAIN OF AN INTERNAL COMBUSTION ENGINE

DESCRIPTION

1. Field of the Invention

The invention concerns a tappet for a valve train of an internal combustion engine.

2. Background of the Invention

A tappet of the pre-cited type is known, for example, from EP-OS 04 54 518. This is supplied directly through a feed duct from the cylinder head, its aperture being connected to the feed duct only in the base circle phase of the cam. As seen in an axial direction of its skirt, the aperture is arranged at a relatively low level. Due to this, during the turned-off state of the internal combustion engine, it can be counted on that its cylindric oil reservoir runs substantially empty of hydraulic medium. On re-starting of the internal combustion engine, detrimental rattling noises are to be noted till the oil reservoir again contains a sufficient amount of hydraulic medium. Moreover, due to the low-level aperture, the hydraulic medium has to be pumped against the hydraulic medium column situated thereabove in the oil reservoir. At the same time, in the region of its lower edge, the tappet comprises a radially outwards bent lug serving as an anti-rotation device. This lug increases the cost of its manufacture and weakens it in the edge region.

DE-OS 43 08 011 discloses a tappet which does not comprise the mentioned anti-rotation device but possesses an annular groove in the skirt by which a hydraulic medium supply to the tappet interior is guaranteed in every position of rotation. Due to this annular groove, relatively large losses of hydraulic medium occur in the feed region. In the case of multi-valve techniques, for example, this can necessitate the enhancing of the oil pump capacity. In addition, this annular groove likewise requires an additional work step. The last-mentioned tappet possesses in its skirt, a bore situated in the direct bottom region for the transfer of hydraulic medium into its reservoir. On the outer peripheral surface of the skirt, there is arranged a longitudinal groove in a bottom-remote direction, which opens into the said annular groove. A person skilled in the art can at the same time discern that a complicated and mass-increasing deflector element for the hydraulic medium is disposed in the interior of the hydraulic medium reservoir. In addition, large losses of hydraulic medium have to be reckoned with due to the relatively long ascending groove. At the same time, these grooves, again, necessitate a relatively highly complicated and expensive manufacture.

OBJECT OF THE INVENTION

It is therefore an object of the invention to create a tappet of the initially cited type which has a simple structure and a leak-tight configuration as well as only a minimum consumption of hydraulic medium.

SUMMARY OF THE INVENTION

The invention achieves this object of an internal combustion engine with the components tappet (1), cylinder head (7) and cams (9) of a camshaft (10) having following features:

the tappet (1) is installed for longitudinal displacement by an outer peripheral surface (5) of its hollow cylindrical skirt (2) in a reception bore (6) of the cylinder head (7) and is loaded by at least one of the cams (9) of the camshaft (10) in the region of a top surface (8) of its disc-shaped bottom (4);

in its interior (11), the tappet (1) has a hydraulic clearance compensation element (13) which cooperates through its pressure piston (14) at least indirectly with at least one gas exchange valve, an annular element (16) which is spaced from the bottom (4) and surrounds the clearance compensation element (13) being arranged in the interior (11) and serving to form an annular oil reservoir (17) which extends towards the bottom (4);

at least one through-aperture (19) for supplying hydraulic medium to the reservoir (17) is arranged in the skirt (2), which aperture (19) is aligned only in the base circle phase of the cam (9) to an end (20) of a supply gallery (21) of the cylinder head (7) intersecting the reception bore (6), the hydraulic medium being conducted directly from the end (20) into the aperture (19) of the skirt (2);

the tappet (1) is provided with an anti-rotation device (22).

Both solutions are based on the aperture situated in the bottom region in the skirt for the transfer of hydraulic medium. In each case, this transfer point communicates with the feed duct from the cylinder head only in a base circle phase. The solution therefore concerns a tappet which, in contrast to the tappet disclosed in EP-OS 04 54 518, is not only configured particularly leak-tight but, at the same time, possesses an extremely easy-to-manufacture anti-rotation device. In contrast thereto, another tappet of the invention, at the same time possesses a separate anti-rotation device in the region of its skirt by reason of which the annular groove of DE-OS 43 08 011 can be dispensed with and the skirt can be made with a smooth surface. At the same time, no complicated oil deflecting elements are required in the interior. In an advantageous development of the invention, the ascending groove is L-shaped or arranged at a slant so that, again, hydraulic communication with the feed duct in the cylinder head is established only in the base circle.

Due to the thus reduced oil leak flows, the oil pump capacity can be reduced. At the same time, due to the measures proposed by the invention, the costs of manufacture of such a cup-shaped tappet are reduced on the whole.

As a further development of the means of the invention, the ring segment on the top surface of the bottom prevents an undesired spurting of the hydraulic medium into the open during a downward movement of the tappet. The ring segment is configured so as to cover the end of the supply gallery even at full cam lift.

In order that the rotation of the cam not be obstructed by the ring segment, the invention proposes to arrange the ring segment, as seen in a top view of the tappet, in a region which permits the largest possible migration of the cam on the bottom of the tappet, while, at the same time, the ring segment is advantageously made in one piece with the tappet. It is also conceivable and within the scope of the invention to make the ring segment, or a similarly suitable element, separately and then connect it to the tappet. Due to the off-center arrangement of the cam, an unobstructed movement of the cam is assured and a relatively large axial dimension of the ring segment is guaranteed at the same time.

Another embodiment of the invention is also intended for use in cases in which it is not intended to modify existing supply galleries in cylinder heads and the supply galleries are situated at a relatively "low" level in the reception bore of the cylinder head. The ascending groove assures the controlled feed of hydraulic medium to the tappet interior. As already mentioned, this ascending groove can be made in a relatively simple manner, for example by a non-chipping method although machining methods may also be used. With this measure, the arrangement of the ring segment can be omitted.

The ascending groove can be made with an L-shape or at a slant but it must be assured that the tappet receives the required minimum supply of hydraulic medium in its base circle.

The invention can likewise be applied to tappets which are installed in the cylinder head at an angle to the direction of gravity. It is advantageous in this case, to arrange the aperture of the skirt in an upper region thereof because, in this way, a very simple prevention of leakage is established. Simultaneously with this measure, but also when the tappet is installed in an upright position, some portions of the annular element can be made to bear against the undersurface of the bottom. This results in a reduction of the receiving capacity of the annular oil reservoir so that in the filled state of the tappet, a reduction of mass is determinable. In the case of a slanting installation, it is advantageous to have the annular element bear against the bottom in the lower region of the tappet. Simultaneously with this, an air vent leading out of the clearance compensation element can be provided therein in the upper part of the annular oil reservoir, the oil transfers recess then being arranged in the lower region of the annular reservoir.

As an anti-rotation device in the skirt, the invention proposes, for example, a roller needle or a similar suitable body. The invention, however, also covers an anti-rotation device extending from the reception bore of the cylinder head.

It is likewise proposed to make the bottom of the tappet cylinder in shape as viewed in camshaft direction. In this way, due to kinematic conversion, the same cam lift curve can be realized on a tappet of substantially smaller diameter, and this has a positive effect on the total mass of the tappet.

BRIEF DESCRIPTION OF THE DRAWINGS

The invention is illustrated in the drawings which show.

DETAILED DESCRIPTION OF THE DRAWINGS

Figure 1:
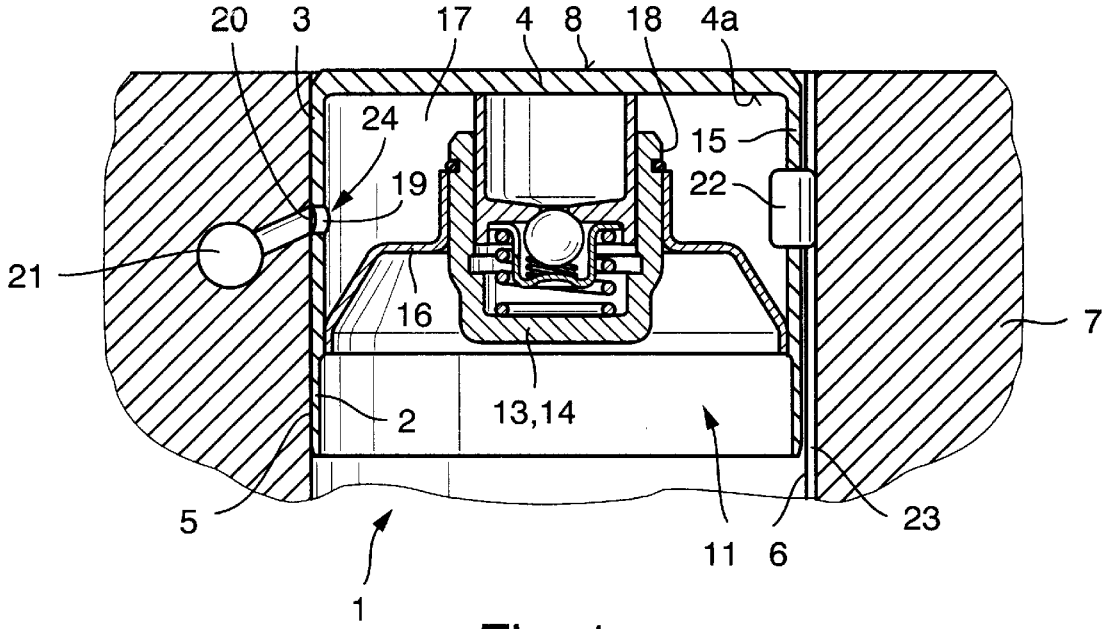
FIG. 1, a longitudinal section through a tappet of the invention with an anti-rotation device.

FIG. 1 shows a tappet 1 for a valve train of an internal combustion engine. No detailed description of such a tappet 1 will be given here because it is sufficiently well-known in the technical field.

The tappet 1 comprises a hollow cylindrical skirt 2 which is closed at one edge 3 by a disc-shaped bottom 4. With an outer peripheral surface 5 of its skirt 2, the tappet 1 oscillates in a reception bore 6 of a cylinder head 7 while a top surface 8 of the bottom 4 is loaded by a cam 9 of a camshaft 10 (see FIG. 4) in lift direction.

In its interior 11, the tappet 1 comprises a hydraulic clearance compensation element 13 arranged concentrically to the skirt 2 and fixed to an undersurface 4*a* of the bottom 4. The hydraulic clearance compensation element 13 cooperates through its bottom-remote pressure piston 14 with an end of a gas exchange valve, not shown. At the same time, an annular element 16 extends radially inwards from the inner peripheral surface 15 of the skirt 2. This annular element 16 serves on the one hand to define an annular oil reservoir 17 which is situated thereabove in cam direction, and on the other hand, to fix the clearance compensation element 13 by abutting against an outer peripheral surface 18 of the pressure piston 14. A through-aperture 19 is arranged in the region of the skirt 2 to allow hydraulic medium to flow in from an end 20 of a supply gallery 21 of the cylinder head 7.

As can be seen further in FIG. 1, an anti-rotation device 22 (configured here in the form of a roller needle or cylinder) is fixed in the skirt 2 of the tappet 1 and extends radially outwardly in a complementary longitudinal groove 23 of the cylinder head 7. Due to the fact that the tappet 1 is guided secure against rotation in its reception bore 6, it is possible to omit cost-intensive annular grooves on the outer peripheral surface 5 of its skirt 2. It is only the aperture 19 that communicates in the base circle phase of the tappet 1 with the end 20 of the supply gallery 21 to let hydraulic medium into the annular oil reservoir 17. This assures that the detrimental, large losses of hydraulic medium by leakage in the region of the reception bore 6 do not occur with this tappet 1. Since the tappet 1 as a whole has a relatively simple structure, its reliability of operation is maintained. Compared to prior art tappets, the total mass is also further reduced.

Figure 2:
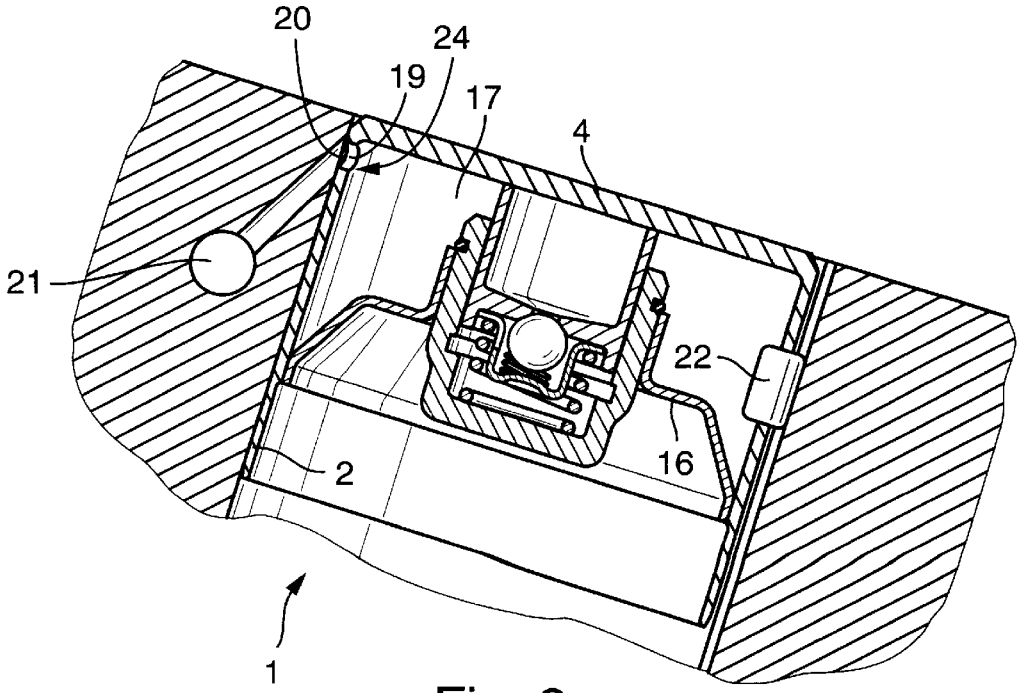
FIG. 2, a view of a tappet installed at a slant in the cylinder head, with the end of the supply gallery arranged at a high level.

FIG. 2 shows a tappet 1 which is installed at a slant in the cylinder head and whose aperture 19 is arranged in the gravity-remote region of the skirt 2. An important feature of this and also of other embodiments is that at least one inlet 24 of the aperture 19 is arranged in this gravity-remote region of the annular oil reservoir 17. This again assures an optimal filling of the annular oil reservoir 17 while simultaneously maintaining a high degree of leak tightness of the tappet 1.

Figure 3:
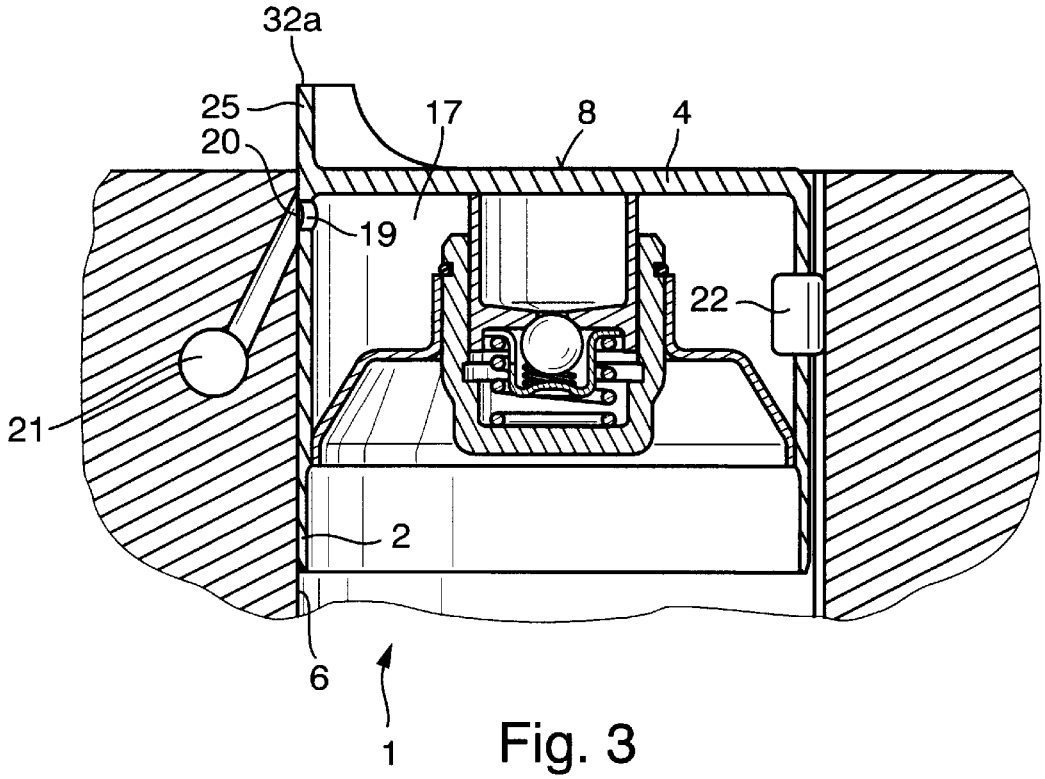
FIG. 3, a view similar to FIG. 1 but with a ring segment of the invention.

FIG. 3 shows a tappet 1 installed in an upright position and comprising a ring segment 25 arranged on the top surface 8 of the bottom 4 and extending in cam direction to form an extension of the skirt 2. When the tappet 1 sinks into its reception bore 6 during cam lift, this ring segment 25 prevents the hydraulic medium from spurting out of the supply gallery 21 into the open. Advantageously, the ring segment 25 has an axial dimension which assumes that the end 20 of the supply gallery 21 is covered even at full cam lift.

Figure 4:
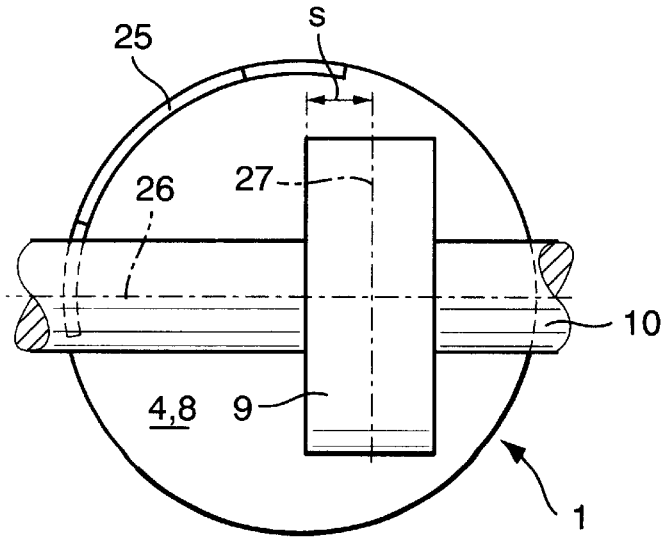
FIG. 4, a top view of the tappet of FIG. 3 in contact with the cam.

As can be seen in FIG. 4, the ring segment 25 is arranged on the top surface 8 of the bottom 4 so as to describe only a quarter of a circle. It extends advantageously in a segment of a circle defined by an axis 26 of the camshaft 10 and a longitudinal center line 27 of the cam 9 which intersects the axis 26.

Figure 5:
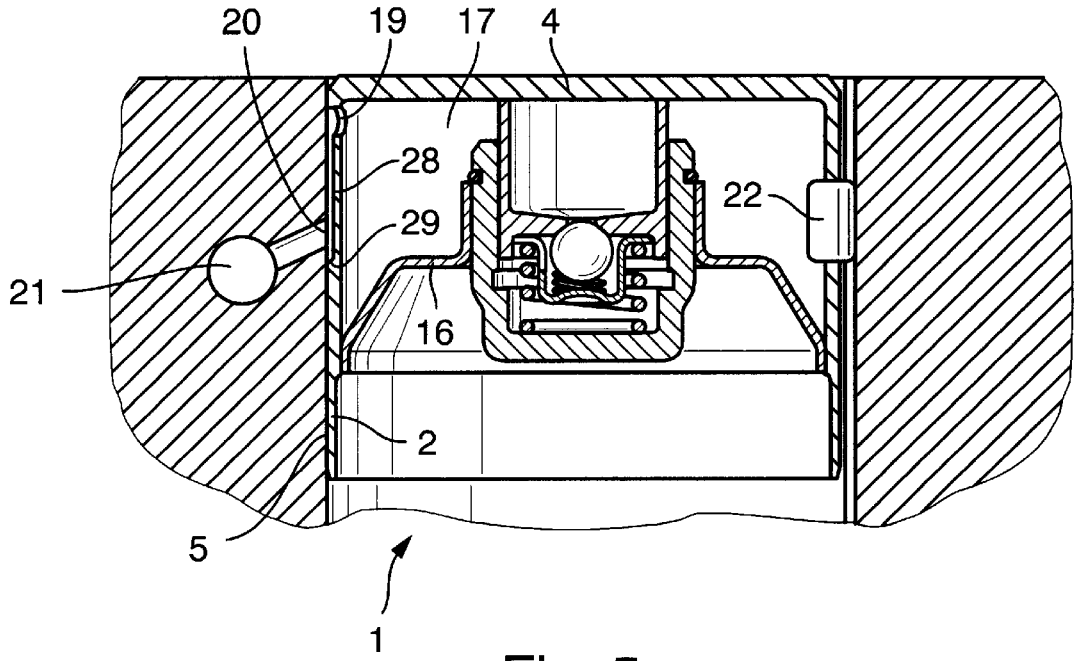
FIG. 5, a section as in FIG. 1, but with the end of the supply gallery arranged at a low level.
Figure 6:
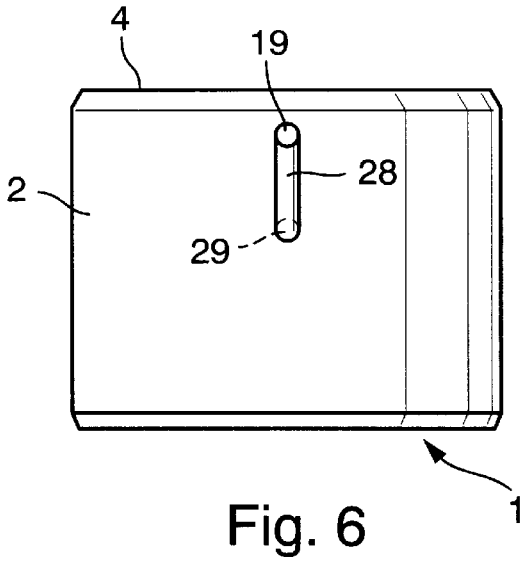
FIGS. 6, 7, side views of the tappet in the region of the inlet for the hydraulic medium, and FIG. 8, again, a tappet installed at a slant, with an optimized oil reservoir.
Figure 7:
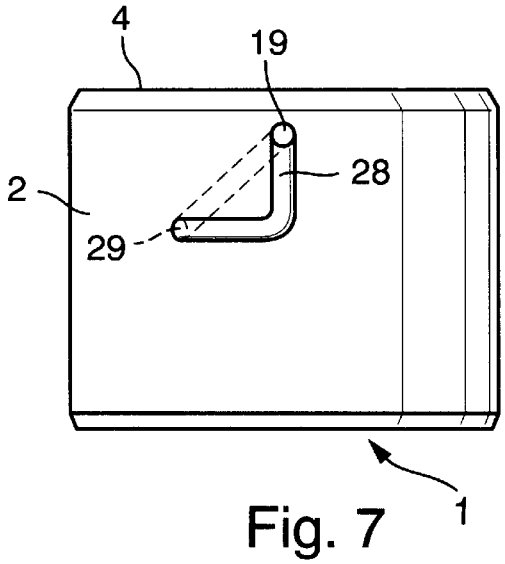

FIG. 5 shows a tappet 1 similar to the precited tappets. However, in this case, the end 20 of the supply gallery 21 is situated at a low level similar to conventional arrangements. In the outer peripheral surface 5 of the skirt 2 there is arranged a longitudinal ascending groove 28 (see FIG. 6) whose lower end 29 is in hydraulic communication with the supply gallery 21 at least in the base circle phase of the cam 9. The ascending groove 28 leads in cam direction to the aperture 19 of the skirt 2. To assure a controlled hydraulic medium supply to the annular oil reservoir 17 only in the base circle phase of the cam 9, the ascending groove may also have an L-shape, or extend obliquely, as shown in FIG. 7.

Finally, FIG. 8 again shows a tappet 1 installed at a slant. Advantageously, in this case, too, its aperture 19 is arranged in an "upper" part of the skirt 2. To further optimize the volume of hydraulic medium enclosed by the annular oil reservoir 17, the lower region 32 of the annular element 16 is made to extend up to the bottom 4. A transfer recess 30 for hydraulic medium is arranged in the undersurface 4*a* of the bottom 4 while being situated in a "lower" region of the reservoir 17. Thus, a reliable supply of hydraulic medium to the clearance compensation element 13 is guaranteed under all conditions of operation. At the same time, an air vent 31 leading from the clearance compensation element 13 into the annular oil reservoir 17 is arranged in a relatively elevated region 34 of the undersurface 4*a* of the bottom 4.

Advantageously, the tappet 1 with its bottom 4 and skirt 2 is made of a material having a thermal expansion coefficient corresponding to that of the cylinder head, e.g. a high alloy steel of the brand X5CrNi1810. But this thermal expansion coefficient may also be slightly higher so that, with increasing warming-up of the material during the operation of the internal combustion engine, the guide clearance occurring between the skirt 2 and the reception bore 6 is further reduced.

Figure 8:
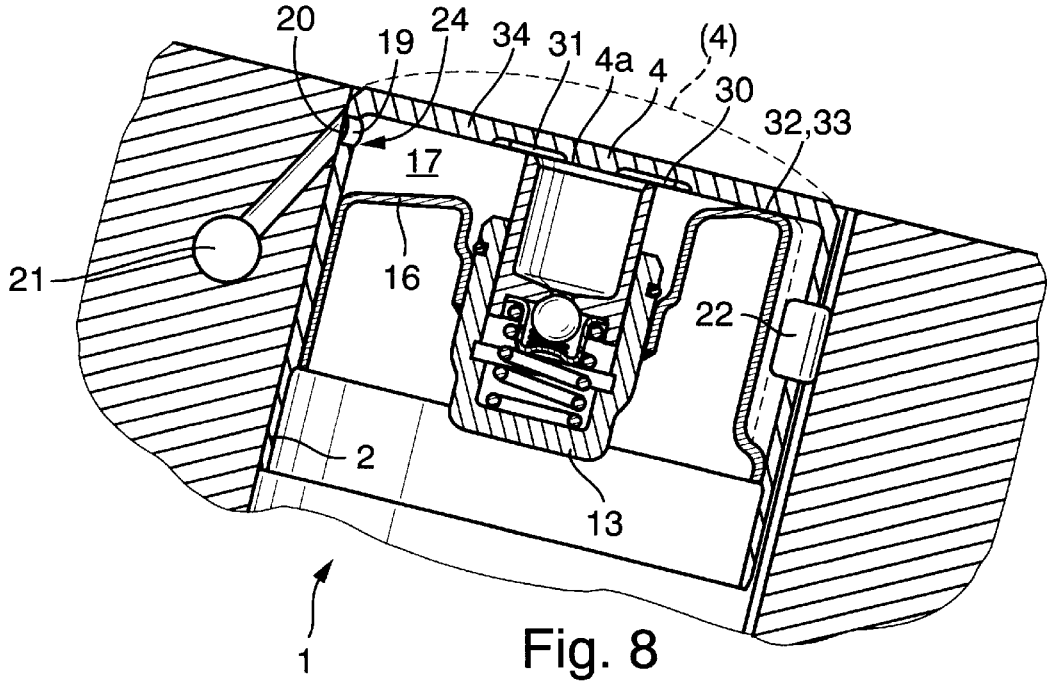

It can likewise be seen in FIG. 8 that the bottom 4 of the tappet 1 as seen in camshaft direction can have a cylindrical configuration. This has the advantage that the contact area for the cam 9 on the top surface 8 of the bottom 4 is further increased so that it is possible to reduce the tappet diameter.

We claim:

1. A valve train of an internal combustion engine with the combustion tappet (1), cylinder head (7) and cams (9) of a camshaft (10) having the following features:

the tappet (1) is installed for longitudinal displacement by an outer peripheral surface (5) of its hollow cylindrical skirt (2) in a reception bore (6) of the cylinder head (7) and is loaded by at least one of the cams (9) of the camshaft (10) in the region of a top surface (8) of its disc-shaped bottom (4);

in its interior (11), the tappet (1) has a hydraulic clearance compensation element (13) which cooperates through its pressure piston (14) at least indirectly with at least one gas exchange valve, an annular element (16) which is spaced from the bottom (4) and surrounds the clearance compensation element (13) being arranged in the interior (11) and serving to form an annular oil reservoir (17) which extends towards the bottom (4);

at least one through-aperture (19) for supplying hydraulic medium to the reservoir (17) is arranged in the skirt (2) which aperture (19) is aligned only in the base circle phase of the cam (9) to an and (20) of a supply gallery (21) of the cylinder head (7) intersecting the reception bore (6), the hydraulic medium being conducted directly from the end (20) into the aperture (19) of the skirt (2);

the tappet (1) is provided with an anti-rotation device (22);

characterized in that the aperture (19) is arranged with its inlet (24) in a region of the skirt (2) closely adjacent to the bottom (4) and the outer peripheral surface (5) of the skirt (2) has a completely smooth cylindrical shape except for a sparing for the anti-rotation device (22) which is made as a cylindrical body.

2. A valve train of claim 1, characterized in that the skirt (2) comprising a ring segment (25) which is made in one piece with the tappet (1) and extends towards the cam from the top surface (8) of the bottom (4) which is contacted directly by the cam, the ring segment (25) being situated, as viewed in axial direction, above the end (20) of the supply gallery (21), and an upper edge (32*a*) of the ring segment (25) is spaced from the end (20) of the supply gallery (21) so that this end (20) is completely covered by the ring segment (25) at full lift of the cam (9).

3. A valve train of claim 2, characterized in that, as seen in a top view of the tappet, the ring segment (25) is situated in a segment of a circle whose arms are defined by an axis (26) of the camshaft (10) projected on the bottom (4) and a longitudinal center line (27) of the cam (9) likewise projected on the bottom (4) and intersecting the axis (26).

4. A valve train of claim 2, characterized in that the cam (9) contacts the bottom (4), off-centered, in a region remote from the ring segment (25) in camshaft direction.

5. A valve train of claim 1, characterized in that the tappet (1) is installed in the cylinder head (7) at an angle to the direction of gravity, and the aperture (19) of the skirt (2) is situated, as seen in the direction of gravity, in a high region thereof.

6. A valve train of claim 1, characterized in that a region (32) of the annular element (16) remote from the aperture (19) is arranged on or near an undersurface (4*a*) of the bottom (4).

7. A valve train of claim 5, characterized in that a transfer recess (30) for the hydraulic medium from the annular oil reservoir (17) to the clearance compensation element (13) is realized by a lower section (33) in the bottom (4).

8. A valve train of claim 5, characterized in that an air vent (31) leading from the clearance compensation element (13) to the annular oil reservoir (17) is arranged in the undersurface (4*a*) of the bottom (4) and extends at an elevated region (34) of the bottom (4).

9. A valve train of claim 7, characterized in that an air vent (31) leading from the clearance compensation element (13) to the annular oil reservoir (17) is arranged in the undersurface (4*a*) of the bottom (4) and extends at an elevated region (34) of the bottom (4).

10. A valve train of claim 1, characterized in that, as seen in camshaft direction, the bottom (4) of the tappet (1) is cylindrical in shape.

11. A valve train of claim 3, characterized in that the cam (9) contacts the bottom (4), off-centered, in a region remote from the ring segment (25) in camshaft direction.

* * * * *